US005829698A

United States Patent [19]

Canada

[11] Patent Number: 5,829,698

[45] Date of Patent: Nov. 3, 1998

[54] ROTOR DESIGN

[75] Inventor: Larry Don Canada, Cascade, Mont.

[73] Assignee: Svedala New Zealand Ltd., Matamata, New Zealand

[21] Appl. No.: 707,662

[22] Filed: Sep. 4, 1996

[51] Int. Cl.[6] ..... B02C 13/09; B02C 19/00

[52] U.S. Cl. ..... 241/275; 241/291; 241/300

[58] Field of Search ..... 241/275, 291, 241/300, 285.1, 285.2

[56] References Cited

U.S. PATENT DOCUMENTS

| | | | |
|---|---|---|---|
| 4,090,673 | 5/1978 | Ackers et al. . | |
| 4,844,364 | 7/1989 | Rossouw et al. . | |
| 4,844,365 | 7/1989 | Rossouw et al. . | |
| 4,896,838 | 1/1990 | Vendelin et al. . | |
| 4,923,131 | 5/1990 | Rossouw et al. | 241/275 |
| 5,037,035 | 8/1991 | Garland | 241/275 |
| 5,044,567 | 9/1991 | Hte et al. . | |

*Primary Examiner*—John M. Husar
*Attorney, Agent, or Firm*—James A. Quinton, Esq.

[57] ABSTRACT

This invention relates to an improved rotor design and in particular to a method of manufacturing a centrifugal rotor into which material is introduced and can exit therefrom as a consequence of the motion of the rotor, characterised by the step of positioning a guide edge so that in order for the material to exit the rotor during movement therefrom, the angular acceleration of the material is changed directly or indirectly by the guide edge to be different from what the angular acceleration would have been without the guide edge.

18 Claims, 6 Drawing Sheets

ROTOR DESIGN

TECHNICAL FIELD

This invention relates to an improved rotor design.

Reference throughout the specification shall now be made to the use of the present invention in relation to rotors for use in vertical shaft impact rock crushers. It should be appreciated however that the principles of the present invention can be applied to rotors used in relation to other equipment applications, for example when crushing material other than rock or in applications where high centrifugal forces are desirable.

BACKGROUND ART

There are two main design considerations when designing rock crushers.

The first consideration is to achieve maximum force of impact either between the rocks or by the rocks on the impact plates and thus maximising crushing activity.

The second design consideration is to have minimum wear on the parts of the rock crusher.

Conventional rock on rock centrifugal rock crushers such as that described in New Zealand Patent No. 201418 have a closed top rotor into which is fed rock. The rotor spins round a vertical central axis and throws out the rock through a defined port in the side of the rotor. This action provides a positive throwing out of the rock which has a horizontal component of movement only. This design achieves a high exit velocity of the rock which then impacts on rock falling outside of the rotor providing the desired crushing action.

An alternative rock crusher has an open top rotor as described in New Zealand Patent Application No. 242378. This has an annular bed or beds surrounding the central rotor. Rock fed into the rotor spins around the inside of the rotor and exits over the radial wall of the rotor.

This rock has both vertical and horizontal components of movement but the exit velocity of the rock from an open top rotor is comparatively slower than that achieved with closed top rotors as described above.

Further, there is slippage of the rock within the rotor and the rock does not stay within the rotor as long as desired for maximum impact outside the rotor. While this problem could be addressed by increasing the speed of rotation of the rotor, this takes additional horse power requiring more expensive machinery and higher energy consumption.

It is an object of the present invention to address the above problems, or at least to provide the public with a useful choice.

Further advantages of the present invention will become apparent from the following description which is given by way of example only.

DISCLOSURE OF INVENTION

According to one aspect of the present invention there is provided a method of manufacturing a centrifugal rotor into which material is introduced and can exit therefrom as a consequence of the motion of the rotor, characterised by the step of positioning a guide edge so that in order for the material to exit the rotor during movement therefrom, the angular acceleration of the material is changed directly or indirectly by the guide edge to be different from what the angular acceleration would have been without the guide edge.

Reference throughout the specification shall now be made to the material as being rock and that the rotor shall be used within a rock crusher.

It should be appreciated that the guide edge can indirectly change the angular acceleration as a consequence of rock interacting with rock build-up formed under the guide edge.

The applicant has found that providing a guide edge so that as a consequence the rock angular acceleration changes leads to a greater exit velocity of the rock from the rotor. Therefore, the present invention is directed towards providing a means by which greater exit velocities and hence greater rock impacts can be achieved with open top rotors, without the need to increase the speed of the rotor.

The guide edge may come in a variety of forms. In one embodiment of the present invention the guide edge may be part of a template which fits on the top of the rotor. The term template can be interpreted to mean a number of templates as well—depending on the context of the text.

While the guide edge may take other forms, for instance it may be an integral part of the rotor, reference throughout the specification shall now be made to it as being part of a template.

The template may have a variety of shapes. In one embodiment, the template may be comprised of flat steel which defines a pentagonal aperture at the top of the rotor. The sides of the pentagon may each act as a guide edge serving to modify the travel of the rocks exiting the rotor. The rocks encountering the rock buildup under the sides of the pentagon are effectively collected and guided to the corners of the pentagon at the periphery of the rotor at which point the rocks exit the rotor.

There may be templates which define differently shaped apertures, however the applicant has found that a prime number of exit points (such as that achieved by triagonal, pentagonal and heptagonal templates) has a greater stabilising effect on the rotor than any even number of exit points (as would be achieved with square or hexagonal shaped apertures). It should be appreciated that the prime number of exit points includes two exit points.

The applicant has also found that the greater the change in angular acceleration that the guide edge can effect in the rock travel, the greater the exit velocity achieved. However, if the template defines a fully bounded aperture within the rotor, then the possible change of acceleration provided by the guide edge and its associated buildup is limited by the total radius of the rotor and the number of sides defined by the template. For example, a pentagon having its points defined by a circle (such as the periphery of the rotor) has the angle of its side with respect to the circle defined by the circle.

In some embodiments of the present invention the aperture formed by the template on the rotor may not be a polygon having its points defined by a circle. Instead, the template may be continuous in that it has a border around the edge of the rotor, but in addition it also has guide edges which intrude closer to the central axis of the rotor than those provided by a template which has its points defined by the peripheral edge of the rotor.

In alternate embodiments of the present invention the guide edges are not continuous with each other and instead are provided by more than one template associated with the rotor.

For example, an open rotor may have five templates with guide edges which intrude closer to the central axis of the rotor than can be achieved by having a continuous template as described previously. This can provide a greater change in radius and therefore a greater exit velocity.

One problem with having a number of templates with guide edges that can intrude even further into the rotor than the continuous template described, is that the rock tends to pass under the template rather than exit where the guide edge of the template meets the periphery of the rotor. To address this problem, some embodiments of the present invention incorporate a non-radial vane which extends substantially downwardly from the template into the body of the rotor.

The provision of the vane has two main effects on the operation of the rotor.

The first effect is that the vane in combination with the guide edge of the template retains and directs the rocks through the exit points (in the general vicinity where the guide edge meets the periphery of the rotor).

A second effect of the vane is that in combination with the template, a pocket is formed within the rotor in which a certain amount of rock is trapped. This trapped rock forms a protective layer covering the inner circumference of the rotor and the adjacent surface of the vane, thus reducing the chances of these eroding as the result of direct contact from fresh rock entering the rotor. To ensure that the vane obtains maximum protection as a consequence of this pocket forming, in preferred embodiments the vane does not extend towards the centre of the rotor further out than the edge of the template to which the vane is attached.

The shape of the templates, their size and position relative to the centre of the rotor all depends upon a number of factors including rock density and size, the speed of the rotor, processing rate desired and the size of the tube feeding the rotor.

For example, one particular type of rock may require a feed tube which is approximately a minimum of 2.5 times the diameter of the rock being fed into the rotor. In this particular situation the corner template which intrudes furthest into the rotor may be a minimum clearance distance (say 10 mm) from the edge of the feed tube. The distance at the peripheral edge of the rotor between the two closest templates may then be a minimum of 1.5 times the maximum feed size entering the rotor. These figures are given by way of example merely to illustrate the variable configurations that the present invention can take.

While the embodiments described previously work well there are a number of features which the applicant believes can be improved upon.

For example, the use of a non-radial vane as described requires extra material and still requires some wear parts.

The existence of sharp exit points can lead to the build up of fines or the lodging of rocks into the corner formed at the sharp exit point. This can lead to unbalancing of the rotor.

Ideally, most collisions within the rotor should be rock upon rock rather than upon wear parts which are expensive to replace and it would be desirable if the rock impact points could be controlled.

Also, ideally there should be an even build up of material within the rotor with no breakaway of material as a result of the operation of the rotor.

In preferred embodiments, the guide edge is provided by a template as previously described which has portions that extend towards the centre of the rotor. The guide edge of the template has a line of symmetry which passes through the point of the guide edge which is closest to the centre of the rotor. For ease of reference this point shall be referred to as the innermost point of the template as opposed to the outermost point which is on the periphery of the rotor.

Moving the innermost point as close to the centre of the rotor as possible enables the rock material entering the rotor to be channelled more accurately. Ideally, the rock should impact on a build up of material not on the wear parts of the rotor. Moving the innermost point of the template ensures that the rock entering the rotor impacts on the build up of material some distance from the exit point of the rotor thus achieving the above objective.

By having the template symmetrical about the innermost point, there is an even build up and no break away material which occurs with asymmetry. This means that no vanes are required in which to hold material to form a pocket as previously described.

In some embodiments of the present invention there may be radial trail plates used. These may be vertical radial trail plates commonly used in rotors to adjust the rock wave build up in the rotor for different feeds and materials entering the rotor. The radial trail plates used are considerably smaller in size than those used for the non-radial vanes.

Templates of various shapes may be used, but in preferred embodiments the template defines an aperture in the form of a clover leaf.

A clover leaf has rounded edges near the exit points which reduces the chances of fines building up or rocks wedging in the corner which could unbalance the rotor.

Further, the applicant has found that an advantageous construction is a clover leaf aperture which is configured so that the exit points for the material within the rotor through the aperture are between 23°–24° from the central axis of each leaf in the clover leaf aperture. For example, the applicant has found in one configuration an exit point greater than 24° causes the rock to flow over the top of the template. An exit point at less than 23° provides little build up of material and what build up there is, is undercut by exiting rock.

In some embodiments of the present invention the distributor plate at the bottom of the rotor is of similar shape to the template above it and thus acts as a wear part.

The aforementioned embodiment has a number of advantages. Provision of a symmetrical template around the innermost point provides an even build up of material and a balanced rotor. Thus, less material and wear plates are required which leads to a less expensive rotor and a lighter one.

By moving the innermost point as close to the centre of the rotor as feasible, a greater length of guide edge is achieved which means greater velocity of the material exiting the rotor.

BRIEF DESCRIPTION OF DRAWINGS

Aspects of the present invention will now be described by way of example only with reference to the accompanying drawings in which.

BEST MODES FOR CARRYING OUT THE INVENTION

Figure 1A:
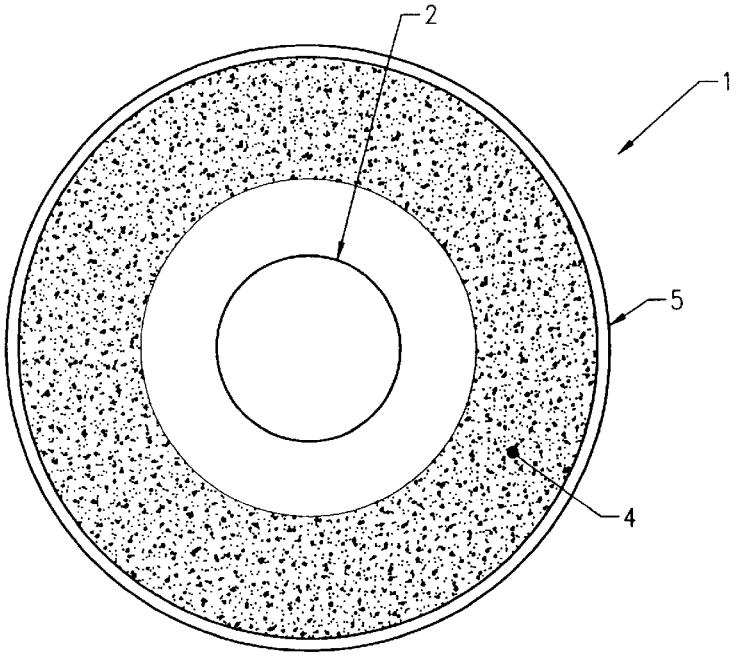
FIG 1a PRIOR ART
FIGS. 1*a* & 1*b* respectively illustrate a plan and cross-sectional view of a conventional open top rotor, and FIGS. 2*a* & 2*b* respectively illustrate a plan and cross-sectional view of one embodiment of the present invention, and FIGS. 3*a* & 3*b* respectively illustrate a plan and cross-sectional view of an alternative embodiment of the present invention.
Figure 1B:
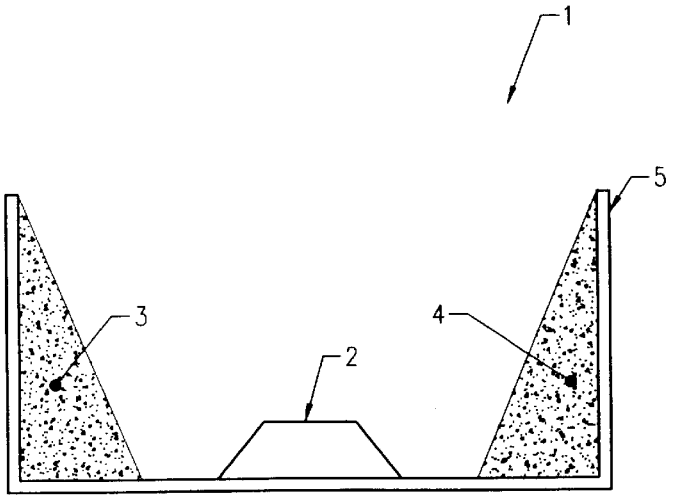
FIG 1b PRIOR ART

FIGS. 1*a* and 1*b* illustrate a conventional open rotor generally indicated by arrow 1.

A feed tube (not illustrated) deposits rock at the distributor plate 2 whereby centrifugal force causes the rock 3 to bank up along the inner peripheral wall 4 of the rotor 1.

The rock 3 provides protection for the wall 4 against the contact of fresh rocks entering the rotor 1.

Fresh rock entering the rotor 1 tends to roll around the bank of rock 3 until it exits the rotor 1 at any point along the peripheral edge 5. Thus, there is no channelling of the rock towards a defined exit point.

Figure 2A:
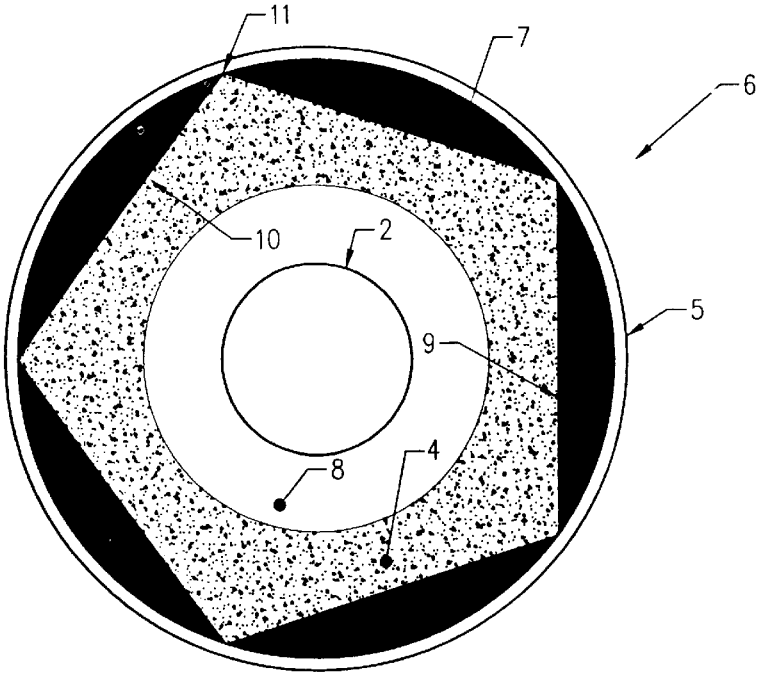
Figure 2B:
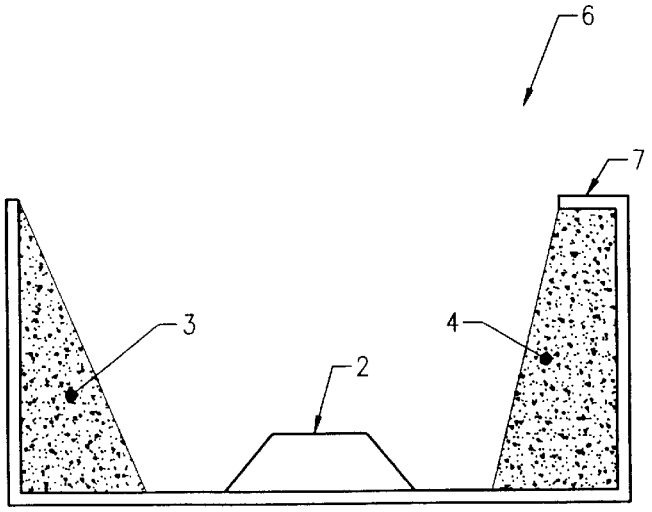

The rotor 6 illustrated in FIGS. 2*a* and 2*b* is substantially the same as the rotor 1. The main difference is that the rotor 6 also includes a template 7. The template 7 fits on the top of the rotor 6 and defines a pentagonal aperture 8.

Rock entering the rotor 6 behaves in a similar manner to the rock entering the rotor 1 until it meets the build-up under guide edges 9 of the template 7. The build-up causes the rock to move from the position of least radial distance from the central axis of the rotor 6 (for example at point 10) to the position of greatest radial distance from the centre of the rotor 6 (for example point 11). It is at point 11 that the rock exits the rotor 6.

Thus, it can be seen that the provision of a template 7 with guide edges 9 acts indirectly or directly to channel the rock to a defined exit point.

This has two effects, the first being to prevent immediate exit of the rock as it reaches the top of the rotor 6 by forcing the rock to travel to the exit point 11 along the guide buildup under the edge 9.

The second effect is that by changing the angular acceleration of the rock, greater velocity is achieved of the rock exiting the rotor 6 leading to greater impacts.

Figure 3A:
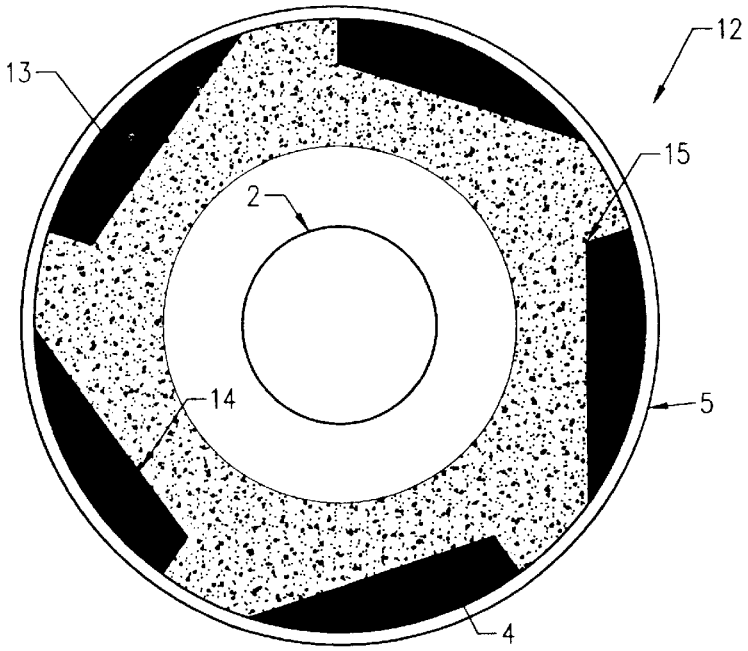
Figure 3B:
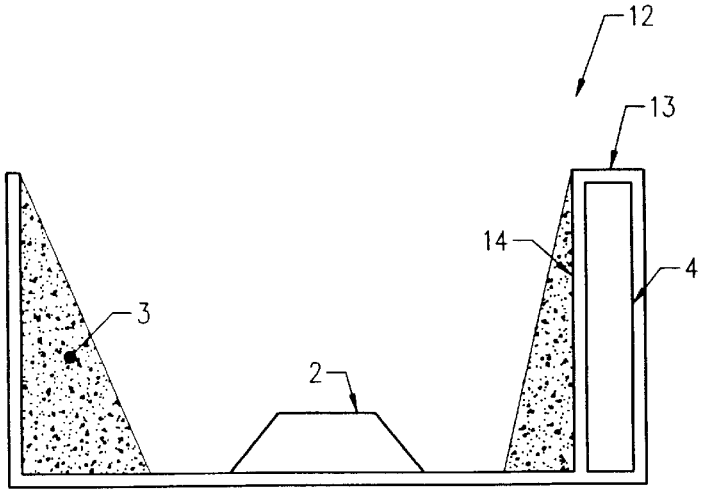
Figure 4:
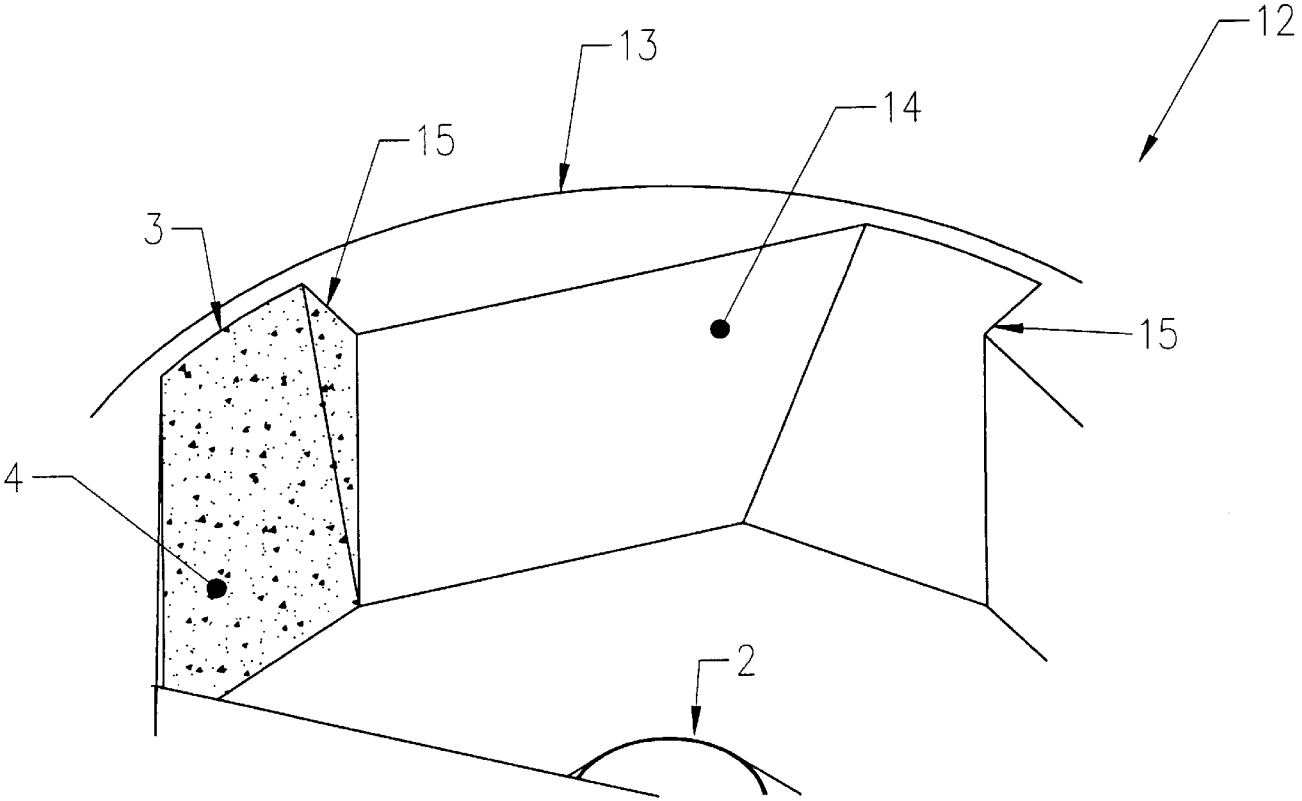
FIG. 4 is a three dimensional view of the embodiment illustrated in FIGS. 3*a* & 3*b*.

The rotor 12 illustrated in FIGS. 3*a*, 3*b* and 4 has similar advantages to that illustrated in FIGS. 2*a* and 2*b*, but more so.

The rotor 12 is essentially the same as the rotor 1 except that in addition it has a number of templates 13 to which are attached vertical vanes 14. The guide edges 15 of the templates 13 protrude further into the rotor 12 than the guide edges 9 of the rotor 6. This enables greater velocity of the rock to be achieved as a result of changing angular acceleration.

The vertical vanes 14 in combination with the templates 13 serve to form a pocket into which rock collects. Not only does this provide wear protection for the inside 4 of the rotor 12, but also ensures that the rock is channelled by the guide edges 15 to the periphery 5 of the rotor 12.

Figure 5:
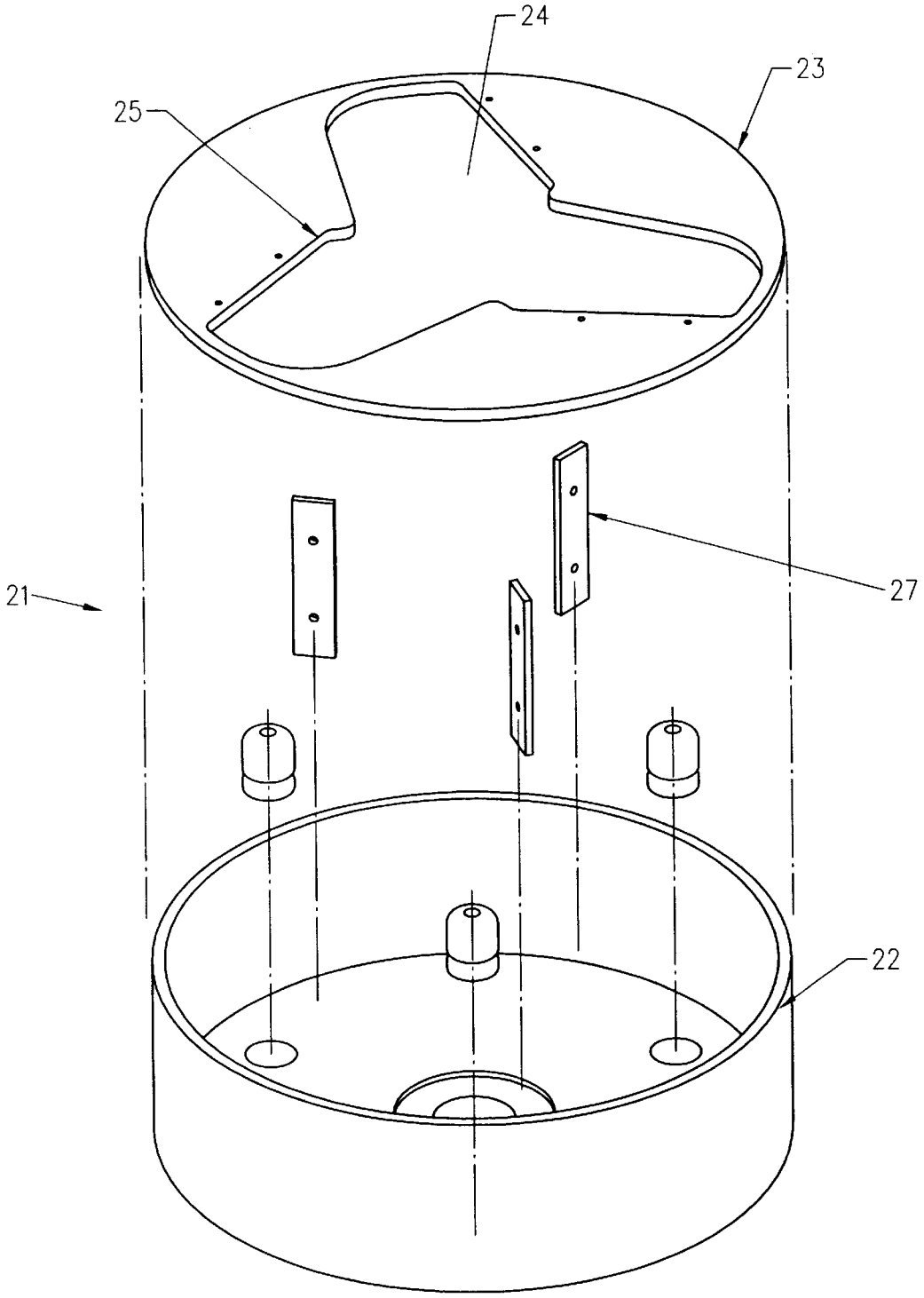
FIG. 5 is an exploded view of a rotor in accordance with a further embodiment of the present invention.
Figure 6:
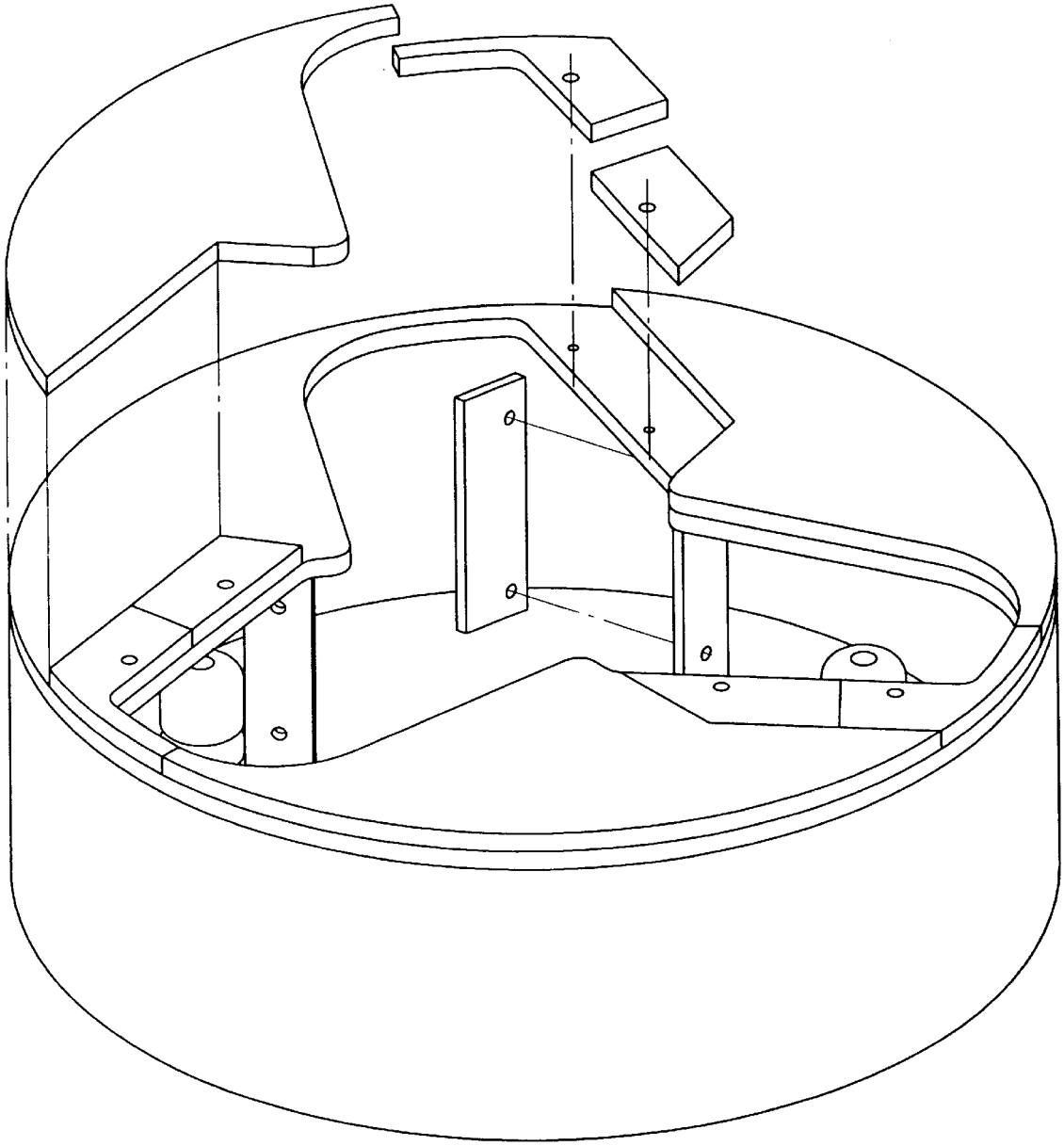
FIG. 6 illustrates wear parts for use with the embodiment of the present invention in FIG. 5.

Referring now to FIGS. 5 and 6, there is illustrated an alternate rotor generally indicated by arrow 21.

The rotor 21 consists of rotor shell 22 on top of which is fitted a template 23. The template 23 has a substantially clover leaf shaped aperture 24.

As can be seen in FIG. 5, the aperture 24 is not quite symmetrical about the innermost points 25 of the template 23. However, in some embodiments of the present invention it is necessary to include wear parts to protect the edges of the template. Suitable wear plates 28, 29, 30 for one embodiment of the present invention are shown in FIG. 6 and it can be seen that the addition of the same effectively makes the template aperture 24 a symmetrical clover shape.

The embodiment illustrated in FIGS. 5 and 6 does not require a vane as illustrated in FIGS. 3*a*, 3*b* and 4. Instead, the build up of material (not shown) within the rotor 21 is symmetrical therefore obviating the need for vanes. However, trail plates 27 are shown which assist in controlling the build up of rock material.

The distributor plate 26 is in some embodiments a similar shape to the aperture 24 thus acting as a wear part for the bottom surface of the rotor 21.

Aspects of the present invention have been described by way of example only and it should be appreciated that modifications and additions may be made thereto without departing from the scope thereof as defined in the appended claims.

I claim:

1. An open top rotor for a rotary impact crusher comprising:

a lower rotor plate;

a side rotor plate forming an enclosure with said lower rotor plate;

a template located on top of the side rotor plate;

said template having guide edges positioned on top of the side rotor plate;

a rotor outlet through said template;

said rotor outlet at least partially formed by at least one guide edge of said template converging with;

i) another edge guide of said template; or ii) a top edge of said side rotor plate.

2. An apparatus as claimed in claim 1 in which at least part of the rotor outlet includes a non-radial vane which extends substantially downwardly from the template into the enclosure formed by the side rotor plate and the lower rotor plate.

3. An apparatus as claimed in claim 1 wherein an area defined by the guide edges of the template, and the top edge of the side rotor plate, extends toward the centre of the rotor.

4. An apparatus as claimed in claim 1 wherein the template is symmetrical about a line passing through the centre point of the rotor.

5. An apparatus as claimed in claim 4 wherein there are four rotor outlets.

6. An apparatus as claimed in claim 1 wherein at least part of the rotor outlet formed by the converging guide edges of the templates comprise rounded converging lines.

7. A rotor as claimed in claim 1 wherein at least part of the rotor outlet is formed by at least one guide edge of the templates converging with another guide edge or the top edge of the side rotor plate, in combination with a recess in the side rotor plate.

8. Apparatus as claimed in claim 7 which includes vertical radial trail plates which extend downwardly from the template into the body of the rotor.

9. Apparatus as claimed in claim 7 wherein the template defines an aperture in the form of clover leaf.

10. Apparatus as claimed in claim 9 wherein the clover leaf aperture of the template is configured so that the exit points for the material within the rotor through the aperture are between 23°–24° from the central axis of each leaf in the clover leaf aperture.

11. Apparatus as claimed in claim 9 wherein the apparatus includes a distributor plate which is substantially shaped in the form of a clover leaf.

12. Wear parts for use with the apparatus as claimed in claim 1.

13. Vanes for use with the apparatus as claimed in claim 1.

14. A centrifugal rotor for use with the apparatus as claimed in claim 1.

15. A rock crusher for use with the apparatus as claimed in claim 1.

16. Trail plates for use with the apparatus as claimed in claim 1.

17. The centrifugal rotor according to claim 1 wherein the angular acceleration of the material is directly changed by the edge guide.

18. The centrifugal rotor according to claim 1 wherein the angular acceleration of the material is indirectly changed by the edge guide.

* * * * *